US005518160A

United States Patent [19]

Michalovic

[11] Patent Number: 5,518,160

[45] Date of Patent: May 21, 1996

[54] MANUAL LINERLESS LABEL DISPENSER

[75] Inventor: Stephen Michalovic, Williamsville, N.Y.

[73] Assignee: Moore Business Forms, Inc., Grand Island, N.Y.

[21] Appl. No.: 322,152

[22] Filed: Oct. 13, 1994

Related U.S. Application Data

[62] Division of Ser. No. 135,999, Oct. 14, 1993, Pat. No. 5,375,752.

[51] Int. Cl.[6] ..... B26F 3/02

[52] U.S. Cl. ..... 225/106; 225/51

[58] Field of Search ..... 225/2, 1, 4, 25, 225/26, 51, 100, 106; 206/390; 242/613.2, 422.4

[56] References Cited

U.S. PATENT DOCUMENTS

| | | | |
|---|---|---|---|
| 2,632,606 | 3/1953 | Krueger | 242/55.2 |
| 4,046,298 | 9/1977 | Schroeder, Jr. | 225/2 |
| 4,124,176 | 11/1978 | Carlson et al. | 242/156 |
| 4,204,618 | 5/1980 | Reed et al. | 225/106 |
| 4,447,482 | 5/1984 | Heinzelman et al. | 225/2 |
| 4,722,493 | 2/1988 | Parry et al. | 242/96 |
| 4,817,798 | 4/1989 | Huang | 206/411 |
| 4,863,027 | 9/1989 | Yano | 225/106 |
| 4,872,623 | 10/1989 | Parry et al. | 242/96 |
| 4,946,086 | 8/1990 | Suuronen et al. | 225/4 |
| 5,076,128 | 12/1991 | O'Conner et al. | 83/698.42 |
| 5,375,752 | 11/1994 | Michalovic | 225/2 |

FOREIGN PATENT DOCUMENTS

| | | | |
|---|---|---|---|
| 2401862 | 3/1979 | France | 242/422.4 |

*Primary Examiner*—Kenneth E. Peterson
*Attorney, Agent, or Firm*—Nixon & Vanderhye

[57] ABSTRACT

Linerless labels are manually dispensed by mounting a roll of the labels for take-off from a stationary shaft. A polygon-cross-section foam core is provided between the shaft and the label roll to provide a brake drag effect to prevent excess label unwind. The non-adhesive face of the labels passes from the roll around a freely rotating guide roller with a non-stick surface which ensures consistent wrap of the labels and no scuffing of the non-adhesive face as the labels are dispensed. The labels pass from the guide roller to a tear surface having a first smooth, coarse, ribbed or grooved pattern metal portion which has low adhesion to the adhesive of the labels, but will stick to the labels sufficiently to provide an anchoring force to a label greater than the force necessary to tear along a perforation of the label, and a second non-stick surface portion. The tear surface preferably is the exterior surface of the a cylinder or tube, and the non-stick surface is provided by a plasma coating on a portion of the metal cylinder or tube exterior surface.

13 Claims, 5 Drawing Sheets

MANUAL LINERLESS LABEL DISPENSER

This is a divisional of application Ser. No. 08/135,999, filed Oct. 14, 1993, now U.S. Pat. No. 5,375,752.

BACKGROUND AND SUMMARY OF THE INVENTION

Linerless labels with pressure sensitive adhesive on one face, and a release coating on the other, are becoming increasingly more popular because they have a number of advantages over conventional lined labels, including the absence of the need to dispose of a liner when the labels are dispensed. However linerless labels pose substantial challenges in developing efficient procedures and equipment for dispensing them. When linerless labels are being dispensed care must be taken to avoid excess unwind of the labels since it can be difficult to properly rewind the linerless labels, and there is always the danger of the exposed pressure sensitive adhesive sticking to components of, or structures adjacent, the unwind apparatus. Also, care must be taken not to scuff the non-adhesive face of the labels, and to properly guide the labels for dispensing.

Another significant problem in the dispensing of linerless labels is sticking of the labels to dispensing apparatus components for separating the labels along their perforations. When a label sticks to the tear surface, lifting the leading edge to start the next label is very difficult, and can unreasonably increase the time required to manually dispense the labels. Also, where blades or like components are used as a force concentrating structure to facilitate tearing of the labels along the perforation lines, the force concentrating structures must be cleaned often to prevent a build up of adhesive.

According to the present invention a simple apparatus is provided which overcomes all of the problems set forth above with respect to the dispensing of linerless labels. That is, the apparatus according to the present invention provides a brake drag effect to prevent excess label unwind, ensures consistent wrap and guiding of the labels with no scuffing of the non-adhesive face as the labels are dispensed from a roll, provides force concentration on the perforation lines without frequent build up of adhesive on structural components, and allows ready access to the free end of the leading label so that dispensing may be accomplished quickly and efficiently. Despite having all of these advantageous features, solving problems existing in the art, the invention is extremely simple, making it relatively inexpensive to construct and utilize and easy to use and repair. Also, the apparatus according to the invention may be used in a novel method for dispensing the labels by facilitating tear-off of the leading label of the web.

According to one aspect of the present invention apparatus for manually dispensing linerless labels having a pressure sensitive adhesive face and a non-adhesive face is provided. The apparatus comprises the following elements: Means for mounting for ready dispensing a roll of linerless labels having the adhesive surface thereof as the inner surface of the labels on the roll. Means for providing label unwind tensioning of the roll by providing a brake drag effect to prevent excess label unwind. Means for insuring consistent wrap of the labels, and no scuffing of the non-adhesive face, as the labels are dispensed from the roll. And, tear surface means including a first surface portion having low adhesion to the adhesive of the labels, and a second surface portion having much lower adhesion to the adhesive of the labels than the first surface, the second surface located further from the means for mounting the roll, along the path of movement of the labels, than the first surface.

The tear surface preferably comprises an arcuate surface, such as the exterior surface of a metal cylinder or tube. The first surface portion comprises a smooth, ribbed, patterned, or coarse metal surface exterior portion of the cylinder or tube, while the second surface portion comprises a non-stick coating on the metal surface. Preferably the non-stick coating comprises a plasma coating. The differential adhesion between the first and second surface portions to the label web adhesive allows ready force concentration on a perforation when a perforation between leading and trailing labels substantially overlies the second surface portion, while a part of the trailing label securely adhesively engages the first surface portion. Application of a force to the leading label then causes detachment of the leading and trailing labels along the perforation, and allows the perforation-defined edge of the trailing label to be readily accessible for the next dispensing action.

The means for ensuring consistent wrap of the labels, and no scuffing of the non-adhesive surface, as the labels are dispensed from the roll preferably comprises a free-rotating guide roll having a lubricated exterior surface for engaging the non-adhesive face of the labels. The lubricated exterior surface may comprise high molecular weight polyethylene (that is the roller may be constructed of that material), or polytetrafluoroethylene (e.g. the exterior surface of the roller can be coated with Teflon®).

The means for mounting the roll for ready dispensing preferably comprises a stationary shaft received within a hollow core of the roll of labels, and having flattened ends which are mounted in a support structure. The means for providing label unwind tensioning may comprise a material disposed between the shaft and the core retarding, though allowing, rotation of the roll about the shaft when an unwind force is applied to the labels. The material disposed between the shaft and the core may comprise a foam core, for example a foam core having a polygon (e.g. square) cross sectional shape. The foam core may have a longitudinal slit allowing ready removal from the shaft for replacement if it wears out, or for cleaning or repair.

A stationary frame having side walls with slots formed therein for receipt of the shaft may also mount the guide roller for rotation about a substantially horizontal axis. The axis of rotation of the guide roller is parallel to the shaft, and is located, typically, below both the shaft and the second surface portion of the tear means.

The invention also relates to a linerless label dispenser mounting structure comprising: A frame comprising first and second upright parallel side walls upstanding from a base plate which is generally perpendicular to the side walls, and connects the side walls, each side wall having a first edge adjacent the base plate, and a free edge most remote from the base plate, and the base plate having a tongue portion extending outwardly from, and not in-between, the side walls. An upright support extending from the tongue portion and having a free end remote from the tongue portion and the side walls, And, a tear surface mounted to the upright support free end, the tear surface having a first surface portion having low adhesion to the adhesive of a labels, and a second surface portion having much lower adhesion to the adhesive of a label than the first surface, the second surface located farther from the side walls than the first surface portion.

The tear surface is preferably as described above. Aligned open ended slots are preferably formed in the side wall free edges. Aligned openings for receiving a guide roller are formed in the side walls closer to the tear surface than the slots, and closer to the base plate than the slots and tear surface.

According to another aspect of the present invention a method of manually dispensing labels from an elongated web of labels in a roll configuration, having perforations spaced along the length of the web, perpendicular to the dimension of elongation of the web, is provided. The web has a pressure sensitive adhesive face, and a non-adhesive face. The method utilizes a tear surface having a non-stick portion which does not adhere to the adhesive face, and a low adhesion portion that is capable of adhesion to the adhesive face to exert a holding force on a label greater than the force necessary to separate the label along a perforation, while still allowing release of the adhesive face therefrom. The method comprises the following steps: (a) Mounting the roll for rotation about an axis of rotation, with a brake drag effect to prevent excess label unwind. (b) Passing the web around a free-rotating roller with the non-adhesive face of the web in contact with the exterior surface of the free-rotating roller. (c) Bringing the leading label perforation of the web into a position substantially overlying the non-stick portion of the tear surface, while the next trailing label adhesive face engages the low-adhesion portion of the tear surface. And,(d) applying a force to the leading label of the web generally perpendicular to the leading perforation (or cause it to be torn angularly across the face of the web) to cause detachment of the leading label from the web at the leading label perforation so that the next trailing label becomes the leading label, and so that the leading edge thereof overlies the non-stick portion. The tear surface is typically arcuate, and step (d) is typically practiced by applying a pulling or snapping force to the web that is generally tangent to the arcuate surface at the perforation.

It is the primary object of the present invention to provide a simple yet extremely effective apparatus and method for dispensing linerless labels. This and other objects of the invention will become clear from an inspection of the detailed description of the invention and from the appended claims.

DETAILED DESCRIPTION OF THE DRAWINGS

Figure 1:
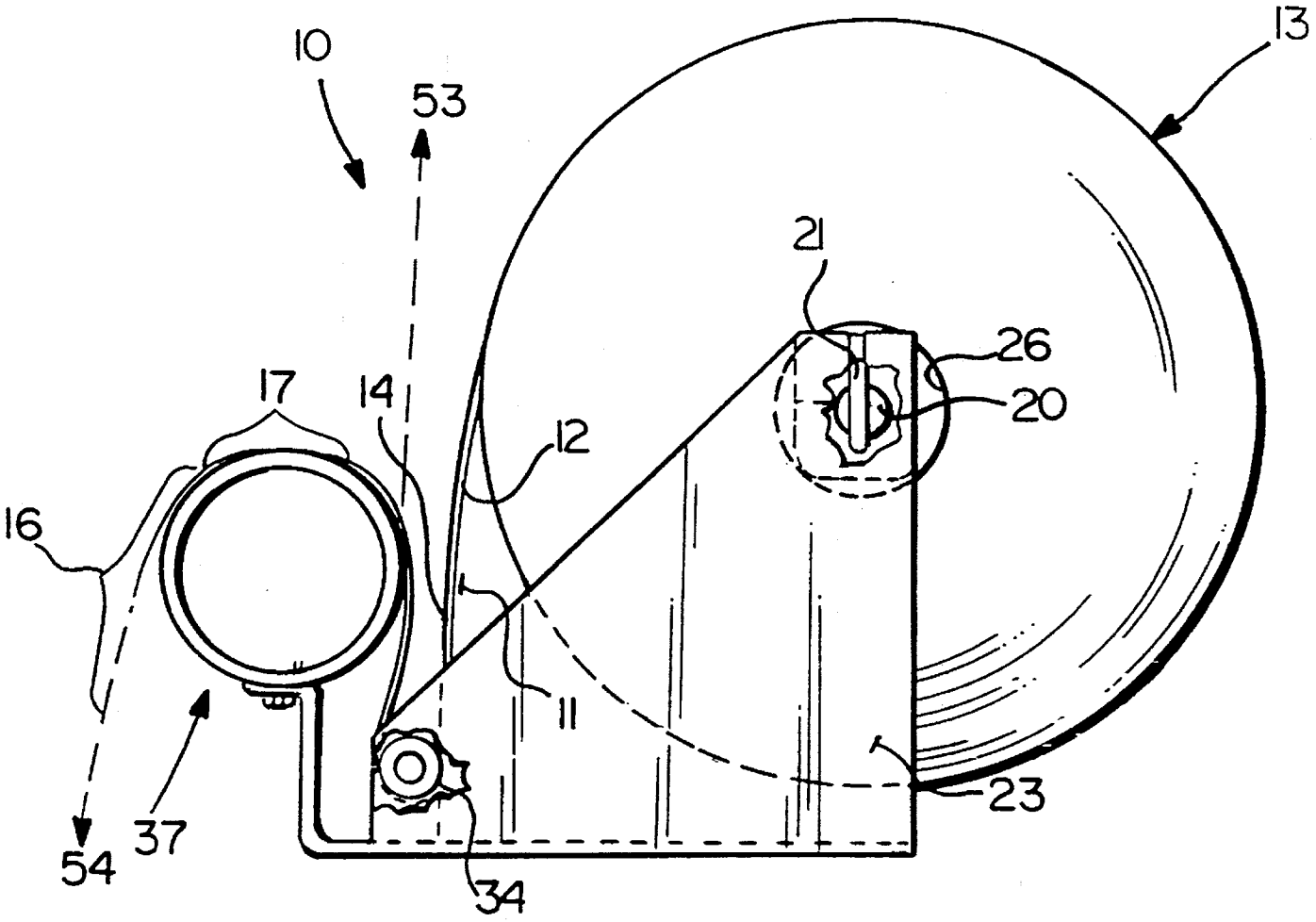
FIG. 1 is a side view of exemplary apparatus according to the present invention, showing a web of linerless labels, in a roll configuration, ill dotted line.
Figure 2:
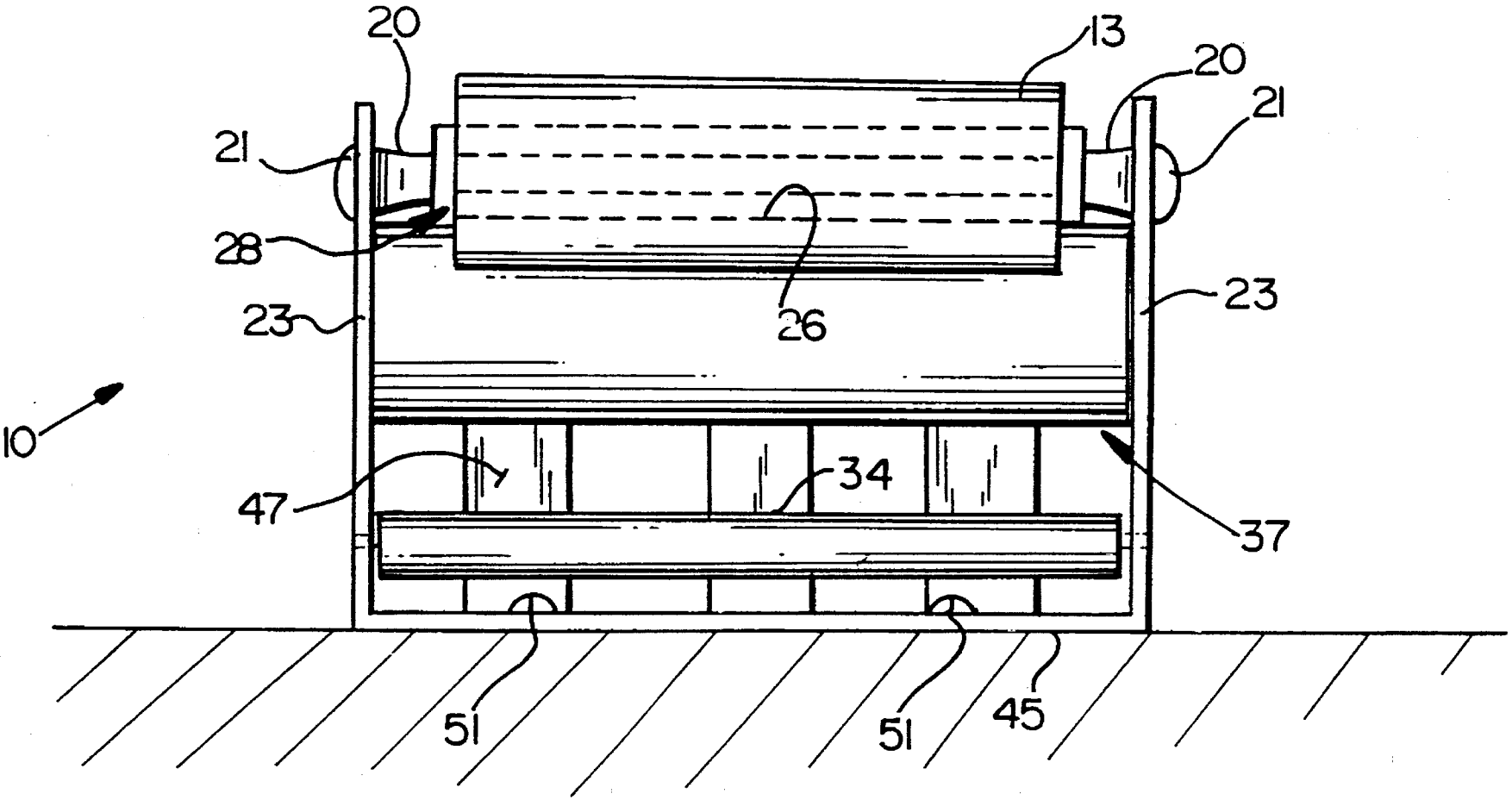
FIG. 2 is a rear view of the apparatus of FIG. 1 with only the roll linerless labels not any extending web, shown in solid line.

Apparatus for manually dispensing linerless labels according to the present invention is shown generally by reference numeral 10 in FIGS. 1 and 2. The linerless labels are in the form of a web 11, having a pressure sensitive adhesive face 12 (which is on the inner surface thereof with the web 11 in the configuration of the roll 13), and a non-adhesive face 14 (the outer face when in a roll configuration 13). Perforation lines 15 (see FIG. 7) are provided at predetermined spaced locations along the web 11 perpendicular to the direction of elongation thereof. The leading label of the web is shown generally at 16 in FIGS. 1 and 7, while the next trailing label is shown by reference numeral 17.

The apparatus 10 includes a means for mounting for ready dispensing the roll 13 of linerless labels. The mounting means preferably comprises a shaft 20, most clearly seen in FIGS. 1, 4, and 6. The shaft 20 preferably comprises an aluminum or steel or other metal tube, typically having a diameter between one and one and a half inches. The ends of the tube are flattened, the flattened ends being illustrated by reference numeral 21 in FIGS. 1, 4, and 5. The mounting means also comprises the slot 22 (see FIG. 3) formed in the side walls 23 of a mounting frame (shown generally by reference numeral 24 in FIG. 3), the slots having open tops 25 so that the shaft 20 and any components mounted thereon may be readily removed from the side walls 23 to allow ready replacement of the roll 13. The flattened ends 21 of the tube 20 are co-planar, and preferably have a maximum width less than the diameter of the core 26 (see FIG. 1) of the roll 13.

Figure 4:
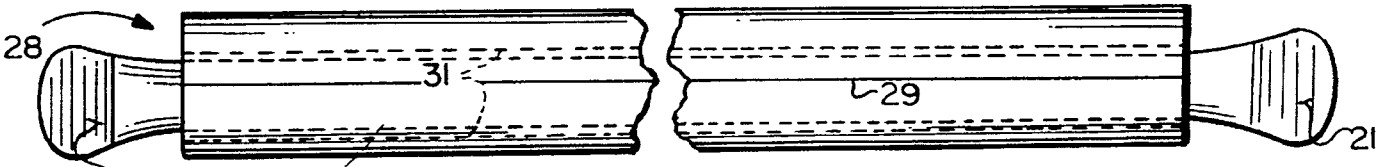
FIG. 4 is a side view of the shaft, and foam core, structure for mounting the roll of linerless labels in the apparatus of FIGS. 1 through 3.
Figure 5:
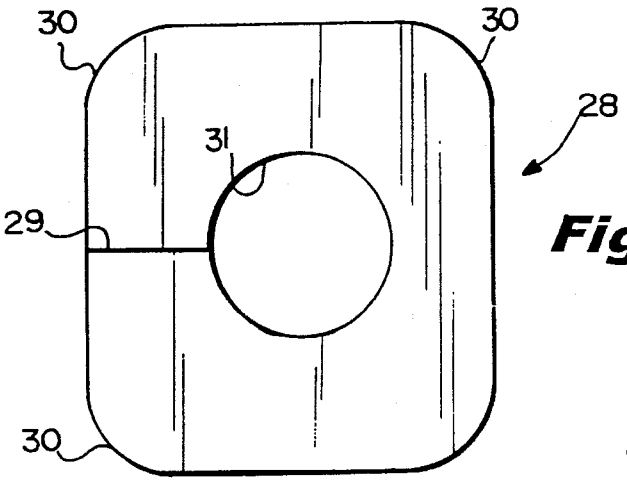
FIG. 5 is an end view of the foam core of FIG. 4.
Figure 6:
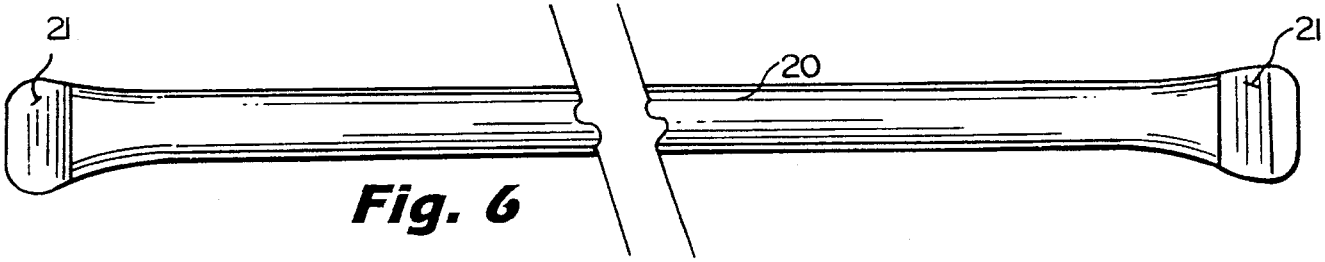
FIG. 6 is a view like that of FIG. 4 only with the foam core removed.

The apparatus 10 also comprises means for providing label unwind tensioning of the roll 13 by providing a brake drag effect to prevent excess label unwind. This is preferably accomplished by providing a material between the shaft 20 and the inner core 26 of the roll 13. This material preferably comprises a foam (e.g. polyethylene, such as available from Thermo-Foam of Buffalo, N.Y.; open cell or closed cell polyurethane; polystyrene; etc.) sleeve or core shown generally by reference numeral 28 and seen most clearly in FIGS. 2, 4, and 5. The foam core 28 typically has a length approximately equal to the length of the tube 20 between the flattened ends 21 thereof, and preferably has a polygon shape in cross-section, e.g. the square shape as illustrated in FIG. 5. It also preferably includes a longitudinal slit 29 (see FIGS. 4 and 5) which allows it to be readily detached from the shaft 20.

The foam core 28 preferably has a polygon shape to provide multiple points, e.g. 30 as seen in FIG. 5, for engaging the core 26 of the roll 13. The points 30 create friction against the tube 20 and the core 26 which slows rotation of the roll 13 about the axis defined by the shaft 20 in both directions. If desired the core 28 could have a circular cross-section of essentially the same diameter as the diameter of the core 26, but this would make the shaft 20—core 28 combination (FIG. 4) difficult to insert in a roll core 26, and would require a larger pulling force on the web to unwind the labels from the roll 13. The inner surface 31 of the foam core 28 (FIGS. 4 and 5) typically is circular in cross-section, however, and it has approximately the same diameter as the diameter of the tube 20 between the flattened ends 21 thereof.

The apparatus 10 further comprises means for insuring consistent wrap and guiding of the labels, as they are dispensed from a roll 13, and no scuffing of the non-adhesive face 14 thereof as they are dispensed from the roll 13. This means preferably comprises the guide roller 34 seen in FIGS. 1 and 2. The guide roller 34 is a free-rotating (idler) roller having the side walls 23 of the frame 24 serving as bearings, or alternatively having conventional bearings.

According to the invention the guide roller 34 preferably has a lubricated exterior surface for engaging the non-adhesive face 14 of the labels. The lubricated, non-stick, surface is desirable even though the roller 34 will not engage the adhesive face 12 of the labels in normal operation in order to prevent adhesive from sticking thereon during initial threading of the web of labels, or aberrant conditions, during which time the adhesive face 12 might inadvertently come in contact therewith. More importantly, however, the lubricating surface is provided so that there will be no scuffing or other damage to the non-adhesive face 14, and to provide smooth unwinding action. The lubricating surface can be provided by making the entire roller 34 of high molecular weight polyethylene, such as available from McMaster Carr of New Jersey, or coating any conventional roller surface with a non-stick material such as polytetrafluoroethylene. The roller 34 is mounted for rotation by its bearings, in most situations, about a generally horizontal axis, the ends of the roller 34 being received within aligned openings in the side walls 23, as indicated by the opening 35 in FIG. 3.

One of the most novel components of the apparatus 10 comprises tear surface means, shown generally by reference numeral 37 in FIGS. 1 through 3 and 7. As seen most clearly in FIG. 3, the tear surface means 37 includes a first surface portion 38 having low adhesion to the pressure sensitive adhesive (whether repositional, removable, or permanent) of the web 11 of labels, and a second surface portion 39 having much lower adhesion to the label adhesive than the first surface 38. The first surface 38 is located closer to the guide roller 34 than the second surface 39; that is the second surface 39 is located downstream of the first surface 38 in the path of movement of the web 11 as it is dispensed from the roll 13.

It is preferred that the tear surface means 37 comprises an arcuate surface, such as formed by the metal tube 40. The tube 40 may, for example, be of a conventional smooth surface steel or like metal, the first surface 38 comprising the exterior of the conventional smooth, ribbed, patterned groove, or coarse metal tube. Within the hollow interior 41 of the tube 40 directions for use of the apparatus 10 may be provided. Alternatively the tear surface means 37 may comprise a metal cylinder, or could have a number of other configurations including those of a hemi-cylinder, many sided polygon, or the like.

A requirement of the first surface 38 is that it must have a low adhesion to the pressure sensitive adhesive associated with the web 11 so that the adhesive will removably adhere to the surface 38, and not adhere to it like it would adhere to a piece of paper or cardboard. This is particularly important if a permanent adhesive is provided for the labels 11. However there must be enough adhesion between the surface 38 and the adhesive of the label web 11 so that when a label is in contact with the surface 38 there is a holding force provided by the adhesive acting between the web 11 and the surface 38 greater than the force necessary to separate the leading label 16 from the rest of the web 11 along the perforation line 15.

The second surface 39 is essentially a completely non-stick surface, having essentially no adhesion with the adhesive of the web 11. The surface 39 may be formed, for example, by a plasma coating over a portion of the exterior surface of the metal tube 40. For example a plasma coating of the type provided by Plasma Coatings, Inc. of Waterbury, Conn. may be provided, such as from the 900 traction/release series (e.g. coating no. 936). For most typical label lengths, if the tube 40 has a diameter of about four inches the plasma coating 39 will have an arcuate length 43 (see FIG. 3) of between about one and three inches, e.g. covering about 10°–180° (preferably about 45°–90°) of the surface of the tube 40. The exterior surface of the tube 40 may be any metal on which a plasma coating can be formed, such as aluminum, and greater or lesser plasma coating arcuate lengths 43 may be provided depending upon the particular lengths, adhesives, and other characteristics of the labels to be dispensed.

Figure 3:
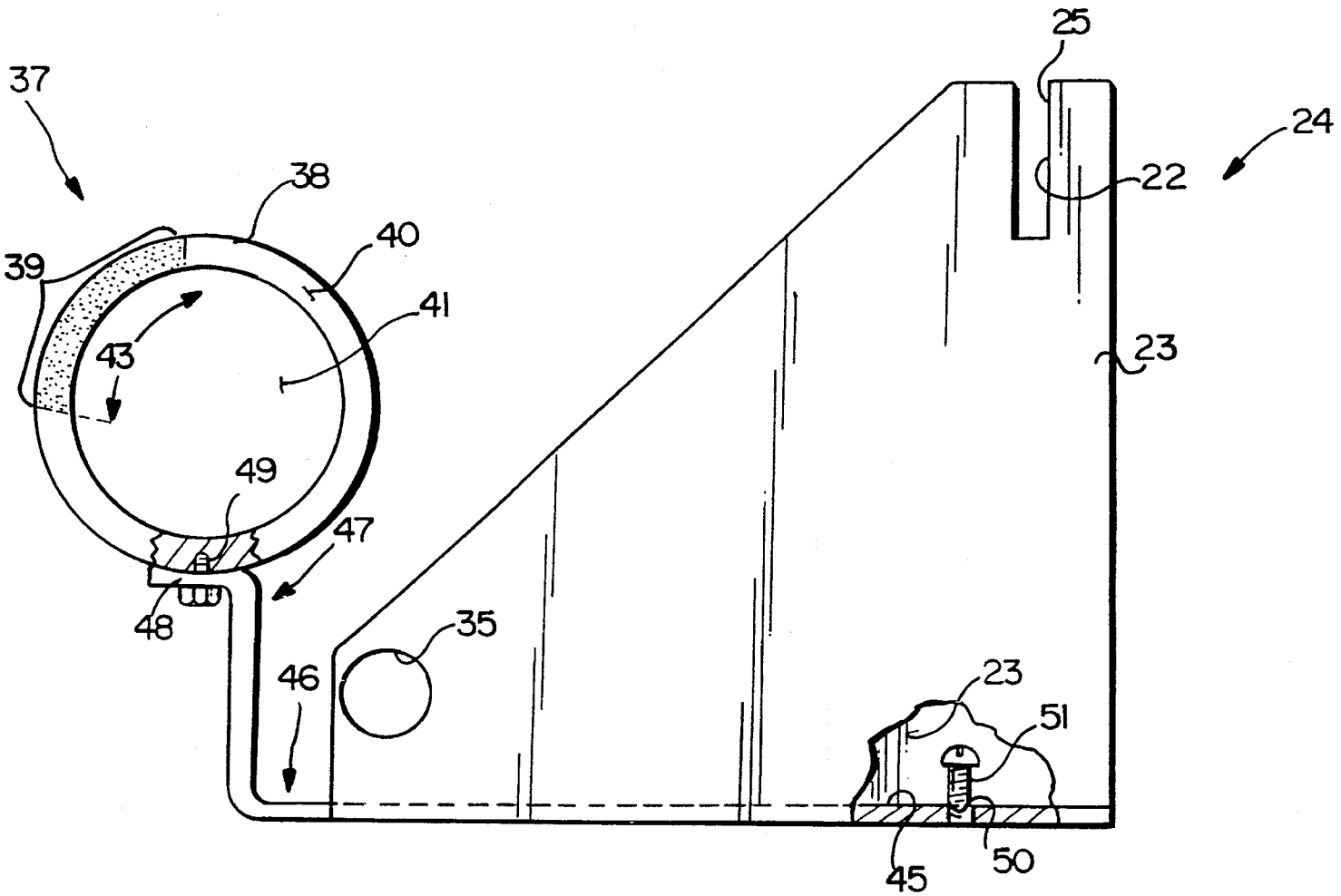
FIG. 3 is a side view of a mounting structure according to the invention, forming part of the apparatus of FIGS. 1 and 2.
Figure 7:
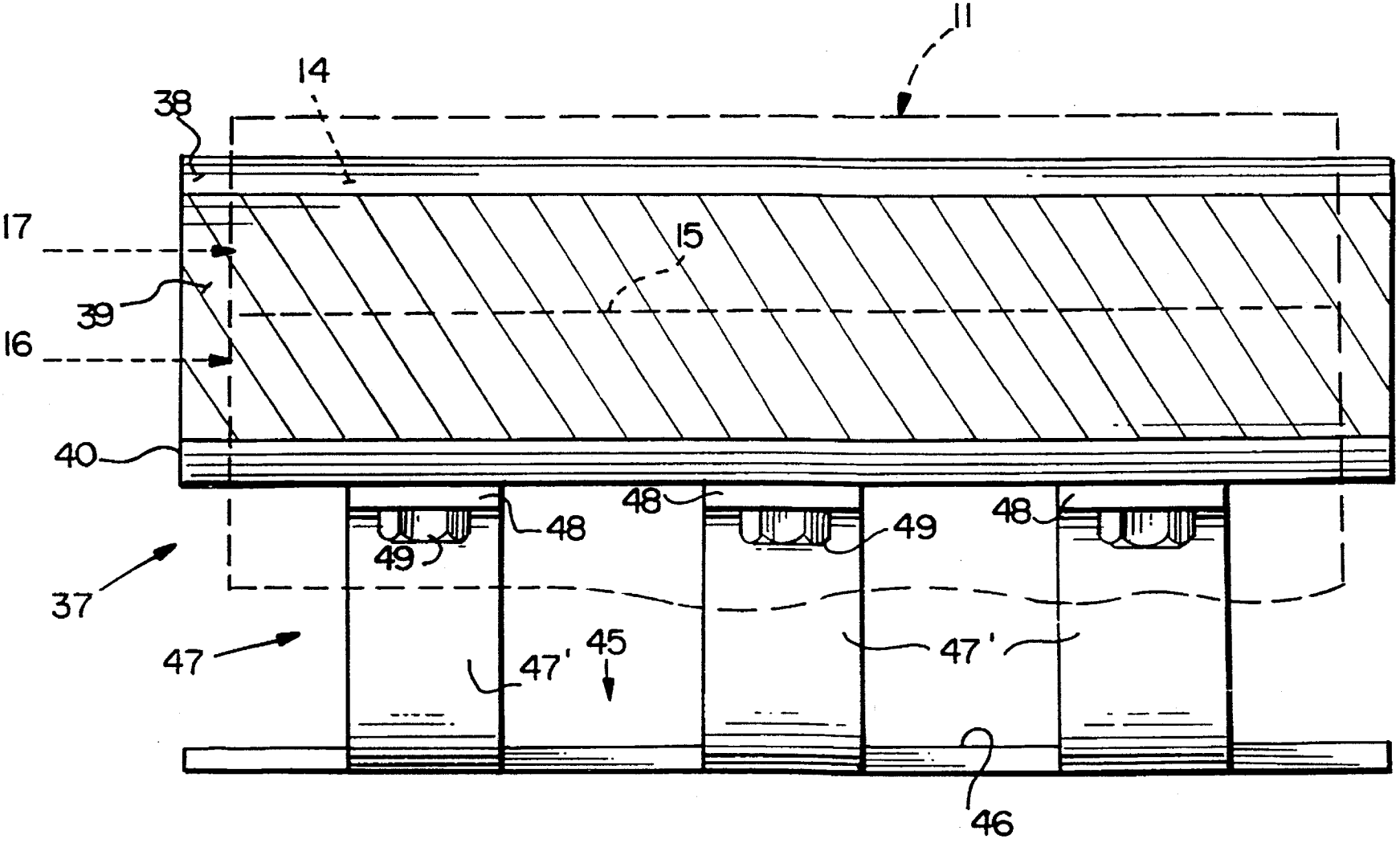
FIG. 7 is a front view of the tear surface means of the apparatus of FIGS. 1 through 3, with labels in operative association therewith being shown in dotted line.

The tear surface means 37 may be mounted as illustrated in FIGS. 1, 3, and 7 by the mounting structure 24. The mounting structure 24, in addition to having the upright metal side walls 23 having the slots 22 and openings 35 therein, includes a base plate 45 (see FIGS. 2, 3, and 7) which connects the side walls 23. The base plate 45 also has a tongue portion 46 (see FIGS. 3 and 7) which extends outwardly from the side walls 23. An upright support, shown generally by reference numeral 47, extends upwardly from the tongue portion 46, and has a free end 48 remote from the tongue portion 46 and from the side walls 43. The upright support 47 may comprise a single plate, or may comprise a plurality of spaced upright tabs, as seen for the tabs 47' in FIG. 7. In any event, the free end 48 of the upright support 47 is connected to the tear surface 37, as by fasteners 49 which may be threaded or otherwise inserted into the body of the tube 40 (see FIG. 3).

The structure 24 is simple, easy, and inexpensive to construct, and may be readily mounted at different locations. Mounting thereof may be easily provided by forming a plurality (e.g. four) of through-extending, spaced, openings 50 in the base plate 45 through which the screw-threaded fasteners 51 (see FIG. 3) may pass to hold the structure 24 on a supporting surface, such as a table top. Of course any other desired holding means, such as adhesive, clamps, welds, or the like may also be utilized.

In the utilization of the apparatus 10 according to the present invention, first the mounting structure 24 is mounted on the desired surface, such as a table top using the screws 51. Then a foam core 28 is placed around a tube 20, between the flattened ends 21 thereof, and the tube 20/core 28 combination is passed into the core 26 of a roll 13 of linerless labels. Then the flattened ends 21 are mounted in the slots 22 of the side walls 23, and the web 11 manually unwound from the roll 13, with the non-adhesive surface 14 of the web 11 passed into contact with the guide roller 34, beneath the axis of rotation thereof. The web 11 is then further pulled up around the guide roll 34, and into contact with the first surface 38 of the tear surface means 37, with the leading edge of the leading label 16 is pulled past the leading edge of the second surface 39.

To quickly and efficiently tear off (dispense) a single label (namely the leading label 16) from the roller 13, the operator merely grasps the leading edge of the leading label 16, lifts up on the labels as necessary to pull the next label 17 away from the surface 38 (see the arrow 53 in FIG. 1 which shows this lifting up action) until roughly one length of label has moved around the guide roller 34, and then pulls the leading label 16 downwardly to wrap the web 11 around the surfaces 38, 39 with the leading perforation line 15 overlying the plasma coating 39 (as seen in FIG. 7). Then a force 54 (see the arrow in FIG. 1) is applied, either a straight downward or snapping force, the force preferably being generally tangent to the arcuate exterior surface of the tube 40 at the area of the perforation 15. The leading label 16 in this position does not stick at all to the surface means 37, however the next, trailing, label 17 has a significant portion thereof which engages the surface 38. The adhesive on the bottom surface 12 of the web 11 provides a sufficient force to hold the label 17 in place on the surface 38 so that the pulling or snapping force 54 will detach the labels 16, 17 along the perforation line 15. Thus this construction not only provides proper force concentration so that the structure "finds" the perforation 15, and will separate thereat, since the perforation 15 overlies the plasma coating 39 the label 17 does not stick to the tear surface means 37 at the leading edge (at what used to be perforation line 15) thereof, and thus the label 17 may be easily grasped for performing the next dispensing operation.

It will thus be seen that according to the present invention a simple yet effective method and apparatus have been provided for manually dispensing linerless labels. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and processes.

What is claimed is:

1. Apparatus for manually dispensing linerless labels having a pressure sensitive adhesive face and a non-adhesive face, comprising:

means for mounting for ready dispensing a roll of linerless labels having the adhesive surface thereof as an inner surface of the labels on the roll;

means for providing label unwind tensioning of the roll by providing a brake drag effect to prevent excess label unwind;

means for insuring straightening of the labels, and no scuffing of the non-adhesive surface, as the labels are dispensed from the roll;

tear surface means including a first surface portion having low adhesion to the adhesive of the labels, and a second surface portion having much lower adhesion to the adhesive of the labels than the first surface, the second surface located further from the means for mounting the roll, along a path of movement of the labels, than the first surface; wherein said means for mounting for ready dispensing a roll of linerless labels having the adhesive surface thereof as the inner surface of the labels on the roll comprises a stationary shaft, received within a hollow core of the roll of linerless labels; and wherein said means for providing label unwind tensioning of the roll by providing a brake drag effect to prevent excess label unwind comprises a material disposed between said shaft and core retarding, though allowing, rotation of the roll about the shaft when an unwind force is applied to the labels.

2. Apparatus as recited in claim 1 wherein said second surface portion comprises a plasma coating on a metal surface.

3. Apparatus as recited in claim 1 wherein said means for straightening of the labels, and no scuffing of the non-adhesive surface, as labels are dispensed from the roll, comprises a free-rotating guide roller having a lubricated exterior surface for engaging the non-adhesive surface of the labels.

4. Apparatus as recited in claim 3 wherein said lubricated exterior surface of said free-rotating roller comprises high molecular weight polyethylene or polytetrafluoroethylene.

5. Apparatus as recited in claim 1 wherein said material disposed between said shaft and core comprises a foam core.

6. Apparatus as recited in claim 5 wherein said shaft has flattened ends, and wherein said means for mounting the roll of labels includes a stationary frame having side walls with slots formed therein, the slots for receipt of said shaft flattened ends.

7. Apparatus as recited in claim 6 wherein said frame side walls also comprise means for mounting said guide roller for rotation about a substantially horizontal axis of rotation, the axis of rotation of said guide roller being parallel to said shaft, and said axis located below both said shaft and said second surface portion.

8. Apparatus as recited in claim 5 wherein said foam core has a polygon cross-sectional shape.

9. Apparatus as recited in claim 8 wherein said polygon cross-sectional shape is a square.

10. Apparatus as recited in claim 5 wherein said foam core has a longitudinal slit allowing ready removal from said shaft.

11. Apparatus as recited in claim 1 wherein said shaft has flattened ends, and wherein said means for mounting the roll of labels includes a stationary frame having side walls with slots formed therein, the slots for receipt of said shaft flattened ends.

12. Apparatus as recited in claim 11 wherein said means for insuring straightening of the labels, and no scuffing of the non-adhesive surface, as the labels are dispensed from the roll, comprises a free-rotating guide roller having a lubricated exterior surface for engaging the non-adhesive face of the labels; and wherein said frame side walls also comprise means for mounting said guide roller for rotation about a substantially horizontal axis of rotation, the axis of rotation of said guide roller being parallel to said shaft, and said axis located below both said shaft and said second surface portion.

13. Apparatus as recited in claim 1 wherein said tear surface means comprises an arcuate surface, said surface portion comprising a smooth metal surface portion.

* * * * *